US005371572A

United States Patent [19]

Sauer

[11] Patent Number: 5,371,572

[45] Date of Patent: Dec. 6, 1994

[54] PORTABLE PHOTOCOPY MACHINE COPY SERIALIZER APPARATUS AND METHOD

[76] Inventor: Scott B. Sauer, 5912 Bixby Village Dr., #66 Long Beach, Calif. 90803

[21] Appl. No.: 40,418

[22] Filed: Mar. 31, 1993

[51] Int. Cl.[5] ..... G03G 21/00

[52] U.S. Cl. ..... 355/202; 355/39; 355/40

[58] Field of Search ..... 355/200, 202, 40, 75, 355/39

[56] References Cited

U.S. PATENT DOCUMENTS

| | | | |
|---|---|---|---|
| 1,835,340 | 12/1931 | Satterlee | 355/40 |
| 3,775,007 | 11/1973 | Davidson | 355/202 |
| 4,653,895 | 3/1987 | Deguchi et al. | 355/1 |
| 4,707,121 | 11/1987 | Sawaki et al. | 355/40 |
| 4,752,806 | 6/1988 | Haas et al. | 355/1 X R |
| 4,782,366 | 11/1988 | Lindsay | 355/40 |
| 4,782,367 | 11/1988 | Noguchi | 355/40 |
| 4,845,525 | 7/1989 | Ito | 355/218 |
| 4,887,128 | 12/1989 | Jamali et al. | 355/202 |
| 4,916,489 | 4/1990 | Takeda et al. | 355/210 |
| 4,975,740 | 12/1990 | Takemura et al. | 355/202 |

FOREIGN PATENT DOCUMENTS

| | | |
|---|---|---|
| 59-202479 | 11/1984 | Japan . |
| 62-148939 | 7/1987 | Japan . |
| 54-106244 | 8/1989 | Japan . |

*Primary Examiner*—Fred L. Braun

*Attorney, Agent, or Firm*—Poms, Smith, Lande & Rose

[57] ABSTRACT

A self-contained portable copy serializer for use with photocopy machines which have a transparent copy window upon which an original document is placed for copying and a copy light which traverses the copy window during copying includes a shallow housing with a variable and incrementable display which may be disposed at the copy window in association with an original document, which may be provided, for example, with a notched out corner or cut out window in which serialization characters are to appear on the copies. The display of the serializer presents to the copy machine window an image of serialization characters which are copied onto the copies along with the image of the document original. The serializer increments the display characters in response to a preselected number of copy machine cycles as indicated by passage of the copy machine light to serialize both single page and multi-page forms, for example.

9 Claims, 2 Drawing Sheets

PORTABLE PHOTOCOPY MACHINE COPY SERIALIZER APPARATUS AND METHOD

BACKGROUND OF THE INVENTION

1. Field of the Invention

The present invention relates to a method, and a portable device for practicing the method, for serializing copies made on a photocopy machine. More particularly, the present invention relates to a portable serializer device which may be placed upon the transparent copy platen or window of virtually any photocopy machine, and which includes a variable multi-character alphanumeric display presented to the copying mechanism within the area of the platen to be copied. In order to serialize copies made on the machine, for example, the original is provided with a notch, cutout, or window within which the display of the serializer is presented to the copy machine as part of the image to be copied. With each copying cycle of the copy machine the serializer either increments the display in preparation for the next copy cycle, or decrements a count down register which allows the display to be incremented after a preset number of copies of the original have been made. Thus, both single page and multi-page forms may be serialized, with each page of the multi-page form bearing the same serial number.

2. Description of the Related Technology

The copy machine art includes several examples of expensive elaborate devices and systems for modifying the image transferred from an original to copies such that additional or different information is copied onto the copies. These prior examples include the possibility of serializing the copies. For the most part, these devices and systems are part of the copy machine itself and may include an image generating display embedded in the copy machine, the image from which is presented at a particular location on copies made on the machine. Moreover, all of these known copy machine serializer methods and devices are complex and expensive, in part because they are a part of the copy machine itself.

For example, U.S. Pat. No. 4,916,489, issued Apr. 10, 1990 to H. Takeda et. al., is believed to teach a copy machine which includes means for erasing part of the image of an original and replacing the erased image with a variable image generated with light emitting devices. The replacement image may include alphanumeric characters, for example, to serialize the copies so produced. However, the device according to the '489 patent is very expensive because it is a part of a complex copying system.

However, there exists a need both for individuals and smaller business operations which either can not afford or justify the expense of a complex copy system such as that set out in the '489 patent to be able to serialize copies made on the now-common photocopy machine. For example, in business operations it is common to make up forms for various uses in the business, which forms should be serialized for various business reasons. One example of this business serialization of forms is the tracking of various business transactions, such as order placement, materials acquisition, manufacturing, inspection, and shipment of finished goods, all which may be scheduled, recorded, and billed for payment, and otherwise processed according to a serial number assigned at the time the order is received from a customer, for example.

Other than having the necessary business forms printed by a professional printer with serialization, or the use of expensive copy equipment like that presented in the '489 patent, hand-written serial numbers on the required business forms is the only other expedient available. Of course, the use of hand-written serial numbers on serialized forms undermines the very reason for serializing the forms because the possibility of human error can result in the same serial number being used on different business transactions, for example.

Professionally printed business forms involve a considerable expense. Additionally, professionally printed forms generally require the ordering of a certain minimum number of the forms or the incurring of even greater printing costs for small orders of serialized forms. Thus, printed forms involve a certain element of cost and storage requirements for the printed forms, as well as a certain lack of flexibility in the business operation because the form used comes to dictate how matters in the business operation are dealt with. A greater flexibility in business operations can be achieved if forms can be made up to fit particular situations, and obtained in the quantities desired without the delay, expense, or storage constraints of using professionally printed forms.

On the other hand, photocopying machines have become very common place today both in business and the home. Generally these common photocopy machines include various features for copy size, speed of copying, enlargement or reduction, and handling of various sizes and types of papers, all dependent on the needs of the user of the machine. However, the image manipulation capabilities and serialization capabilities of the '489 patent have not become generally available because of their cost and complexity.

SUMMARY OF THE INVENTION

In view of the above, there exists a need for a small, comparatively simple, and simple to use, portable copy serializing device which may be used with virtually any photocopy machine. Such a copy serializer would not be a part of the copy machine itself but should be configured as a stand-alone accessory device which would simply lay on the transparent copy plate of the photocopy machine and provide with a variable alphanumeric display of the device a serialization image copied onto the copies so produced along with the image of the original which is also copied onto the copies.

Further to the above, an object of the present invention is to provide such a portable copy serializer device.

Another object of the present invention is to provide such a copy serializer which does not require power from the copy machine, but which is self-powered.

Yet another object for the present invention is to provide a copy serializer of the above-described type which is incremented selectively by each cycle of the copy machine or by a set number of copy cycles of the copy machine so that both single page forms as well as multi-page forms may be serialized with the use of the device.

Accordingly, the present invention provides both a method, and a device for use in the practice of the invention, for serializing copies made on the common photocopy machine. The device includes a housing on one face thereof presenting an alphanumeric display. The display may be incremented in response to each cycle or a number of cycles of a photocopy machine. A sensor of the device senses copying cycles of the photocopy machine in order to effect the incrementation of the display. The device includes its own power source, so the device provides a stand-along capability for copy serializing. Consequently, the device is usable with virtually any photocopy machine which will accommodate the device on the transparent copy window of the copier along with an original document to be copied.

BRIEF DESCRIPTION OF THE DRAWING FIGURES

FIG. 1 provides a perspective view of a copy serializer according to the present invention;

FIG. 2 presents a bottom surface view of the serializer of the present invention, and including depiction of a variable alphanumeric display of the device as well as a sensor window;

FIG. 3 is a schematic representation of a microprocessor-based control architecture of the device seen in FIGS. 1 and 2; and FIGS. 4–6 are flow diagrams of a control program implemented with the control architecture of the present copy serializer.

DESCRIPTION OF THE PREFERRED EMBODIMENT

Figure 1:
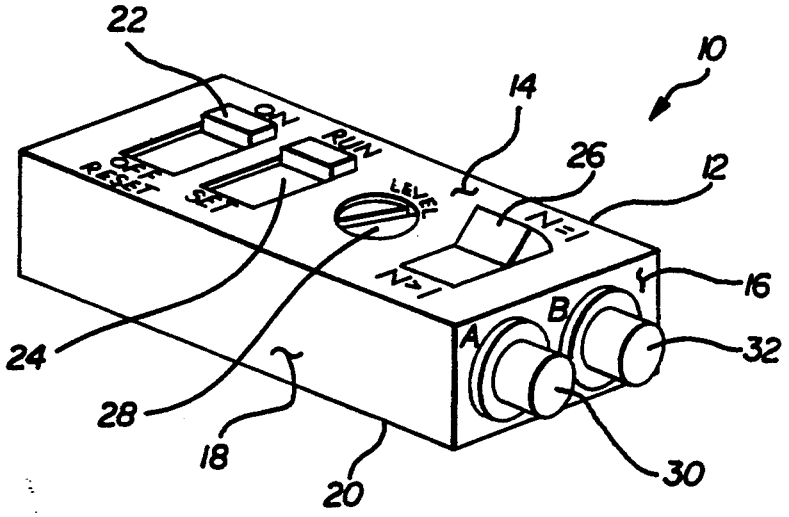

Viewing FIG. 1, a copy serializer 10 is depicted in perspective view. The serializer 10 includes a shallow rectangular housing 12 having an upper surface 14, end surfaces 16, and side surfaces 18, as well as a bottom surface 20, which is best seen viewing FIG. 2. On the upper surface 14 of the housing 12, the copy serializer 10 includes an on/off switch 22, which also serves as a reset switch for the device, as will be explained. Also on the upper surface 14 are disposed a run/set switch 24, a form-size switch 26, and a trigger intensity level adjustment referenced with the numeral 28. At one end surface 16, the copy serializer includes a pair of push button setting switches 30 and 32, the uses of which will be further explained in connection with the architecture and operation of the copy serializer 10.

Figure 2:
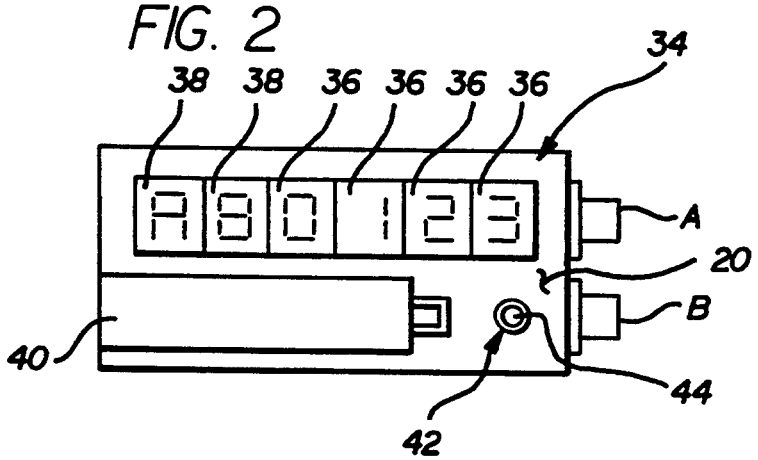

Viewing the bottom surface 20 of the serializer 10, as is seen in FIG. 2, it is seen that the serializer 10 includes a display which is generally referenced with the numeral 34. While the preferred embodiment of the invention includes a six character display 34 including four 8-segment numerical character displays 36, and two alphabetical character displays 38, the scope of the present invention is not limited to such an arrangement. The present preferred embodiment is exemplary only, and illustrates one example of the implementation of the invention. Alternative display layouts could include, for example, all numerical characters, or all alphabetical characters. However, the present display layout of two alphabetical characters and four numerical characters allow great flexibility in serializing with a low cost. For example, if the two alphabetical characters are preset and not incremented, each provides twenty six different possibilities for serialized form families. That is, a total of 676 different form series can be serialized with the serializer 10, as depicted. Further, the four numerical characters are incremented with each copying of a serialized form so that a total of 9999 forms can be made in each series before that particular series would be exhausted or have to start over again.

Further to the above, while the display 34 is of the liquid crystal or liquid crystal shutter type, such is also not limiting on the present invention. For example, light emitting diode display elements could be used to form the display 34. However, liquid crystal or liquid crystal shutter display elements are preferred because of their small power consumption, which is important in a small portable device such as the present serializer in order to provide long service life between battery changes, and because of their good level of contrast which copies well with modern photocopy machines.

Further, still viewing FIG. 2, the serializer 10 includes on surface 20 a removable door 40 by which a battery (not shown) may be inserted into the serializer 10 to power this device. Also included on the surface 20 is an opening 42 behind which is disposed a photoreceptor device 44, such as a phototransistor or photodiode, serving when the serializer 10 is disposed upon the copy window of a photocopy machine, to inform the serializer of each copying cycle of the machine by response to the passage of the intense copy light of the machine.

Figure 3:
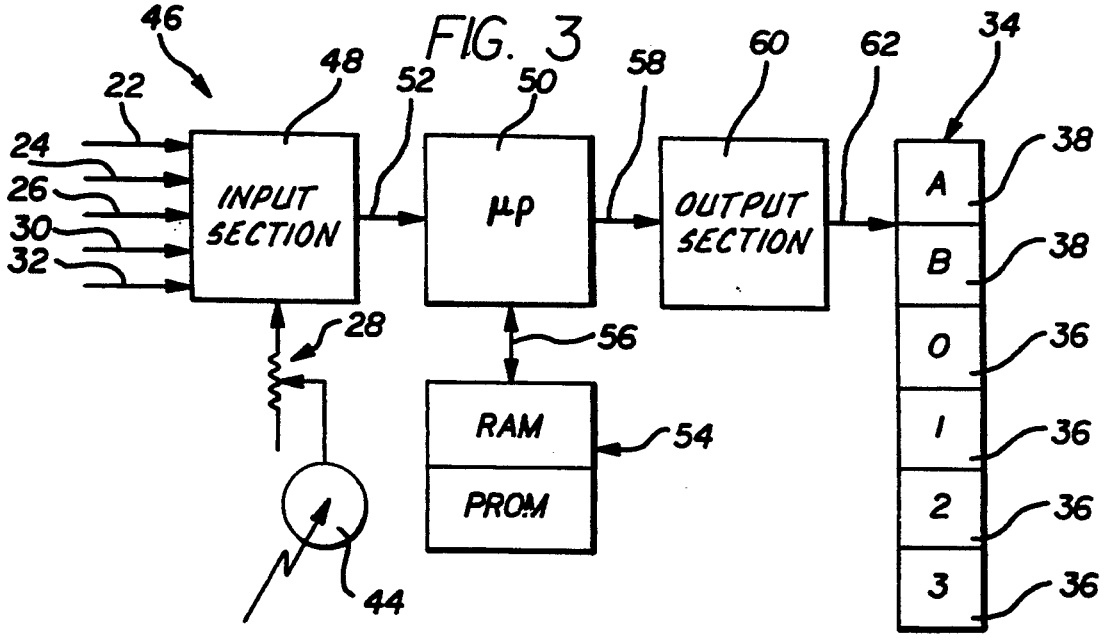

Viewing now FIG. 3, the architecture of the microprocessor based controller 46 of serializer 10 is depicted. The controller 46 is housed within housing 12, and includes an input section, generally referenced with the numeral 48. Input section 48 receives inputs from the on/off switch 22, from run/set switch 24, from the form size switch 26, and from photoreceptor 44 via level control 28.

It will be noted that the level control 28 is schematically depicted as a voltage dividing variable resistor on FIG. 3. While the actual implementation of the level control so indicated may vary from that of a voltage dividing resistor, as will be well understood to those ordinarily skilled in the pertinent arts, the function of the level control as modifying the responsiveness of photoreceptor 44 to incident light is well apparent. In fact, the principle use of the level control 28 is to set a level of response to incident light on the receptor 44 that the serializer 10 does not mistakenly respond to or interpret as a copying cycle the ambient light level in the room where it may be located when set. Only the intense light level provided by passage of a photocopy machine copy light across the window 42 is to be interpreted by the serializer 10 as a copy cycle, and this level of response is easily achieved by manipulation of the level control 28 by a user of the serializer 10.

Additionally, when the run/set switch 24 is in the set position, the input section 48 also receives inputs from the switches 30 and 32, as will be further explained. The switch inputs to input section 48 are schematically indicated on FIG. 3 with the appropriately numbered arrows connecting into the section 48. All of the input information to input section 48 is available to a microprocessor 50 via a data link schematically depicted with the numeral 52. While a variety of microprocessors may be used to implement the control functions required for controller 46, which will be further explained hereinbelow, the time available between copy cycles of even the fastest of the inexpensive common photocopy machines should allow the controller 46 to utilize an inexpensive 8-bit or even a 4-bit microprocessor with satisfactory results. Of course, should improvements in inexpensive common photocopy machines make faster copying rates possible, and thereby make less time available between copying cycles in which to effect the control functions for the serializer 10, a 16-bit microprocessor could be used to greatly reduce the required time during which the control program is run by the microprocessor 50.

As will be further explained, the controller 46 includes a memory section, generally referenced with the numeral 54 and interfaced with the microprocessor 50 via a two way data link 56. Memory section 54 includes both a random access memory (RAM) portion, and a programmable read-only memory (PROM) portion. As those ordinarily skilled in the pertinent arts will appreciate, the functions of the serializer 10 may easily be altered and supplemented by replacing the PROM portion of the memory section 54 with another PROM which is programmed differently without otherwise changing the architecture of the serializer 10. Also, while the present depiction and description of the serializer 10 is predicated upon the assumption that the user of the serializer is using the English language and alphabet, the serializer 10 may easily be employed to serialize photocopies with other than English alphabetic characters, and even with numerical or other characters other than Arabic numerals, should such be desired. A change of the PROM portion of the memory section 54, along with provision of appropriate display elements capable of forming the characters desired is all that is necessary to employ the serializer 10 with other languages, for example.

Microprocessor 50 also has connection via a data link 58 with an output section, referenced with the numeral 60, and including a driver for the display 34. The output of the display driver of output section 60 is provided to the display 34, as is indicated by the arrow 62 on FIG. 3. Thus, the microprocessor 50 accepts inputs from the user of the serializer 10 and from the copy machine with which the serializer is associated in use, and implements a serializing program which is yet to be described, to drive the display 34 in a selected way presenting serializing characters to the copy machine, which characters are then included on the copies made as explained above.

Figure 4:
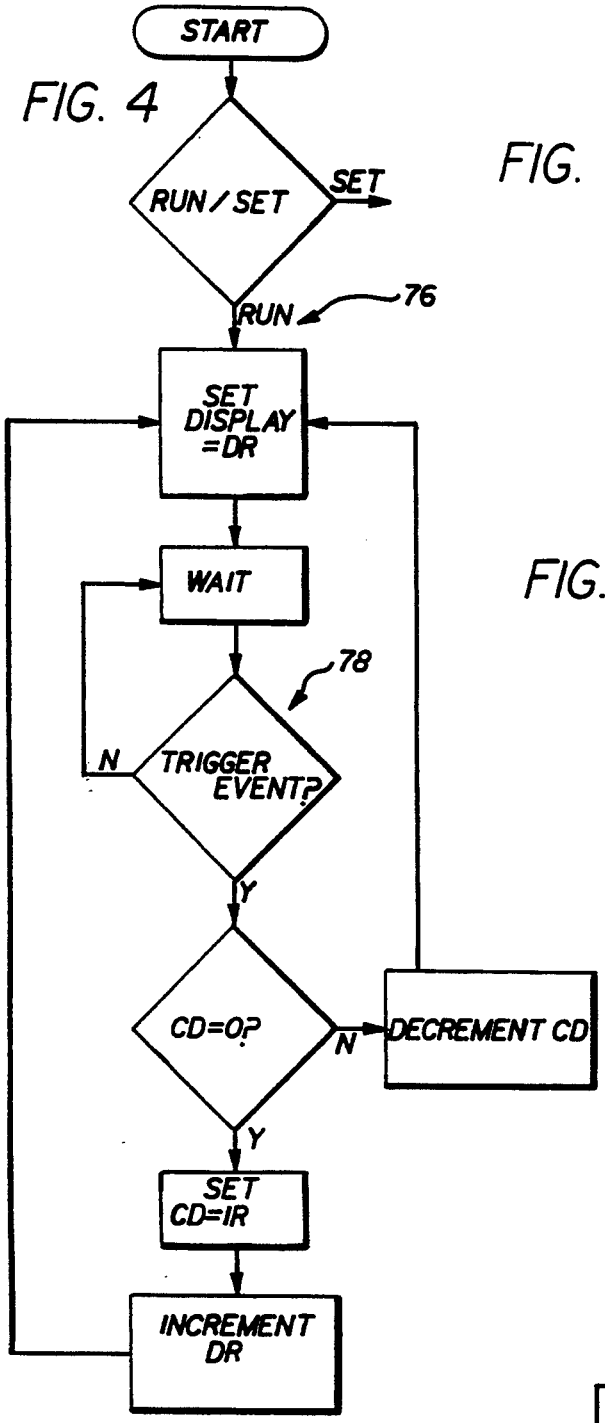
Figure 5:
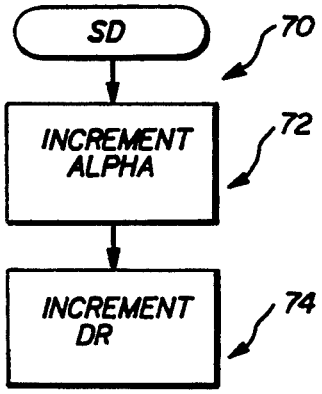
Figure 6:
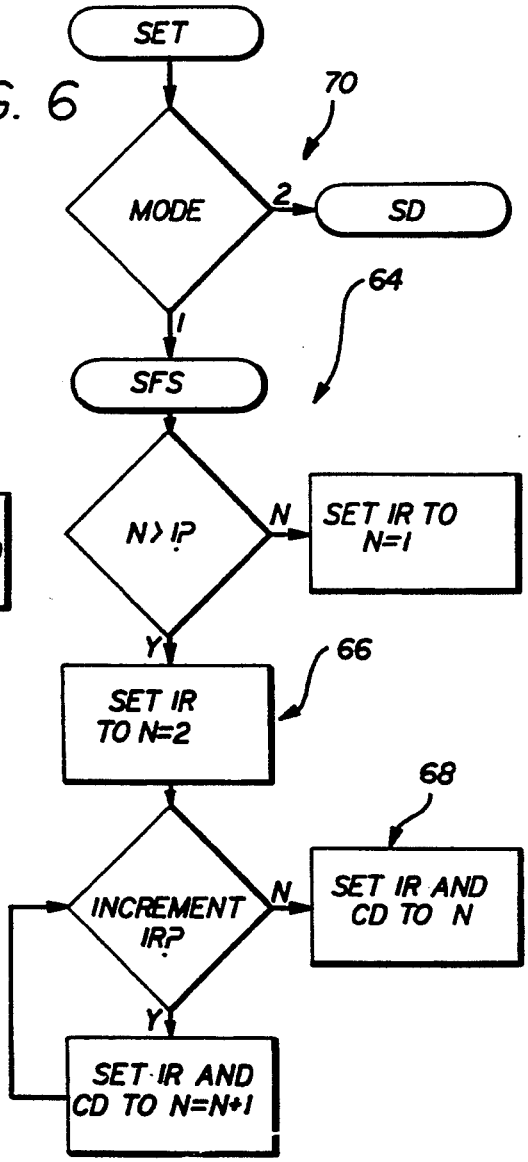

Considering now FIGS. 4–6, the flow chart for the serializing program implemented by the controller 46 of serializer 10 is set out. Those ordinarily skilled in the pertinent arts will immediately recognize the great flexibility in control functions provided by the microprocessor-based architecture of the controller 46. Accordingly, while the following description is presently preferred and is exemplary, it is by no means limiting on the invention. Those ordinarily skilled in the pertinent arts will immediately recognize additional functions which they may wish to add to the serializer 10. As pointed out above, such addition of functions may be achieved by the simple expedient of programming and substituting a different PROM into the serializer without otherwise changing the invention here presented.

Viewing FIG. 4, the on/off switch 22 functions also as a reset switch for the controller. When the serializer 10 is turned on the user is presented with a preselected display. Preferably, the preselected display reads, "AA0000". By setting the set/run switch to the set position, the user of the serializer enters a preparatory setting part of the control program, which is indicated on FIG. 6 generally by the numeral 64. This setting part of the control program includes two modes, the first for setting the selected form size to be serialized (abbreviated, "SFS"), and the second for setting the initial reading of the display (abbreviated, "SD") at the beginning of serialization.

The first or form size setting part of the setting mode is entered automatically by the controller 46, and the user of the serializer 10 will set the form size selection switch to either a single page form size (i.e., $N=1$) or to a multi-page form size (i.e.,$N>1$). If the user has set the form size switch to the $N=1$ position, the controller will immediately enter the display setting mode, which will be explained. Also, the controller 46 sets an internal increment register (abbreviated as "IR" on FIG. 6) and an internal count down register (abbreviated as "CD") both to 1.

However in the event that a multi-page form is to be serialized, the controller must be set to account for the number of pages in each form so that each page will have the same serial number. In order to set the controller for a multi-page form size, the first two digits of the display 34 are used to indicate to the user the value to be placed into the registers IR and CD, which value is equal to the number of pages in the form to be serialized. As is indicated at 66 on FIG. 6, the display 34 will initially read "02", because as a convenience, the register IR is initially set to 2 if the form size select switch is not in the $N=1$ position. If the form to be serialized is not a two-page form, the user of the serializer 10 may first use the push button switch 30 to advance the ones value of the form size number by momentary pushes on this switch, or may press and hold this switch to slew upward through the ones values or back to zero. By pressing switch 32, the user changes to setting the tens value of the form size number, which is then set in the same way as the ones value. As the user sets the form size value on the display 34, the values of the IR and CD registers are set to the same values, as is indicated at 68 on FIG. 6.

Those ordinarily skilled in the pertinent arts will recognize that a greater number than ones and tens could be preset for the form size. However, the preferred embodiment of the invention allows setting the first two digits of the display 34 for form size so that forms up to 99 pages in length may be serialized with the present preferred embodiment of the invention.

After setting both the form-size digits on the display 34, the user presses and holds the switch button 32 for a selected time, which may be about two seconds, to switch to the second setting mode, as is indicated on FIG. 5 at 70 and abbreviated as "SD". The display returns to its initial reading of "AA0000". The user may toggle back and forth between the two setting modes by pressing and holding the switch 32 to check or change the form size value set into the serializer should such be desired. However in the second mode of setting, the switched 30 and 32 are used to select and to set the alphabetical characters (72 on FIG. 5) to be displayed at locations 38, as well as the numerical incremental value to be displayed at locations 36 at the beginning of a serialization (74 on FIG. 5).

Once the serializer 10 is prepared for serializing as described above, the user sets the switch 24 to the run position, as indicated at 76 on FIG. 4. This switch position change causes the display 34 to change to or remain at the chosen alphanumeric indication for the start of the serialization which was set during the second setting mode (as is indicated at 78 on FIG. 4).

Having set the serializer 10 in preparation to a serialization run, the user then associates the serializer with an original document on the copy window of a photocopy machine, as was described above. This association may, for example, involve providing the original document with a notched out corner or cut out window in which the serialization characters are to appear on the copies, and laying the original on the copy window with the serializer 10 disposed in association with the original with the display 34 presented to the copy window of the machine through the notch or window of the original document.

When the user begins running copies of the original document, the serializer 10 senses each passage of the intense copy light of the photocopy machine as it passes the opening 42 on face 20. This intense light passage event is characterized as a trigger event on FIG. 4 at 78. When a trigger event happens (i.e., a copy of a page of the original document is made) the controller 46, decrements the count down register by one but does not change the display 34 unless the value of the count down register is zero. If the countdown register has reached zero, the controller 46 knows that the last page of a multi-page form has been copied, and increments the display by one while also resetting the countdown register to the value of the increment register (i.e., to the value indicating the number of pages in the form being copied and serialized). The controller 46 is in an unending loop of counting down the pages of the form being serialized and incrementing the display 34 with each complete copy of the form. Thus, the user of the serializer 10 may choose to make any number of copies of the form within the number limitation imposed by the size of display 34, as was pointed out above.

An alternative mode of operation for the serializer 10 is possible with those copy machines which traverse their copy light in both directions while illuminated (i.e., the copy light is on during both a copying movement of the copy light and during a return movement across the copy window). With this type of copy machine, the serializer 10 will count each passage of the copy light as a trigger event, even though only one copy is made. Thus, a user of the serializer will set the form size indication to twice the actual number of copies in a multi-page form, and forms up to 49 pages (indicated as SFS=98) can be serialized.

When the serialization run is completed, the user of the serializer 10 may reset it as indicated above to prepare the serializer for another serialization operation. While the present invention has been depicted and described, and is defined with reference to a particularly preferred exemplary embodiment of the invention, such reference does not infer a limitation on the invention, and no such limitation is to be implied. The invention is intended to be limited only by the spirit and scope of the appended claims, giving full cognizance to equivalents in all respects.

I claim:

1. A portable self-powered photocopy machine copy serialization device for use with a photocopy machine which includes a transparent copy window upon which a document original is placed for copying an image of said document original onto copies thereof, and a copy light traversing said copy window during copying a said document original, said device comprising:

a housing providing on one face thereof both a variable incrementable multi-character display which is presentable to said photocopy machine on said copy window thereof for copying onto said copies along with said image of said document original, and a sensor responsive to passage therepast of said copy light of said copy machine to produce a signal;

a controller for receiving said signal, said controller incrementing said display in response to a selected number of copying cycles of said photocopy machine;

input switch means for in a first mode of operation of said copy serializer selecting both said selected number of copy cycles and an initial value of said display at the outset of said serialization, and for placing said copy serializer in a second mode of operation in which said controller is responsive to said signal to increment said initial display value successively with each selected number of copy cycles of said photocopy machine; and a dedicated power source for said copy serializer within said housing.

2. The photocopy machine copy serializer of claim 1 wherein said controller includes a microprocessor, and said microprocessor includes a count down register which is set with said selected number of copy machine copy cycles and decremented with each signal from said sensor, and said microprocessor incrementing said initial display value successively higher by a value of one for each time said count down register reaches zero as well as resetting said count down register to said selected number of copy machine copy cycles.

3. The photocopy machine copy serializer of claim 2 where said sensor includes a photoreceptor, and a sensitivity adjustment for setting a trigger level of said controller indicative of passage of said copy light as distinguished from ambient light.

4. The photocopy machine copy serializer of claim 1 wherein said input switch means includes slew switches for incrementing said display to indicate said selected number of copy machine copying cycles as well as said initial display value at the outset of serialization.

5. The photocopy machine copy serializer of claim 4 wherein said housing is a shallow rectangular shape and includes on one of a pair of opposite faces thereof said display and said sensor, and on the other of said pair of opposite faces at least one of said input switch means.

6. A photocopy machine copy serializer for use with a photocopy machine having a transparent copy window upon which document originals are disposed for copying, said serializer comprising:

a housing providing an display which is presentable to said copy machine at said copy window for copying along with a document original;

a controller incrementing said display in response to a selected number of copy cycles of said photocopy machine, said controller including means for sensing each copying cycle of said photocopy machine; and means for inputting to said controller both said selected number of copy cycles and a selected initial display setting which said display is to present to said photocopy machine at the outset of copy serialization;

wherein said means for sensing of said controller includes a photoreceptor disposed on said housing to respond to passage of a copy light of said photocopy machine; and further including means for setting a trigger level of said controller in response to said photoreceptor, whereby ambient light is not mistaken for said copy light of said photocopy machine.

7. A method of serializing copies made on a photocopy machine having a transparent copy window on which document originals are disposed for copying, said method including the steps of:

providing a copy serializer with a housing disposable on said copy window with said document original;

on said copy serializer housing providing a display which may be copied along with said document original;

sensing each copy cycle of said photocopy machine, and incrementing said display in response to the sensing of a selected number of said copy cycles;

including the additional step of providing a dedicated power source to said copy serializer; and further including the steps of setting into said copy serializer a number value equal to the number of pages of an original document which is to be serialized with the same serial number on each copy page, and setting both an increment register and a count down register to said page number value.

8. The method of claim 7 additionally including the steps decrementing said count down register by one in response to each sensed copy machine copying cycle, and upon said count down register reaching zero resetting said count down register to the value of said increment register.

9. The method of claim 8 further including the step of incrementing said display by one upon said count down register reaching zero.

* * * * *